US008584740B2

(12) United States Patent
Figus

(10) Patent No.: US 8,584,740 B2
(45) Date of Patent: Nov. 19, 2013

(54) PASSIVE DEVICE WITH MICRO CAPILLARY PUMPED FLUID LOOP

(75) Inventor: Christophe Figus, Dremil Lafage (FR)

(73) Assignee: Astrium SAS, Paris (FR)

( * ) Notice: Subject to any disclaimer, the term of this patent is extended or adjusted under 35 U.S.C. 154(b) by 814 days.

(21) Appl. No.: 12/672,659

(22) PCT Filed: Jul. 11, 2008

(86) PCT No.: PCT/FR2008/051313

§ 371 (c)(1),
(2), (4) Date: Jun. 28, 2010

(87) PCT Pub. No.: WO2009/019377

PCT Pub. Date: Feb. 12, 2009

(65) Prior Publication Data

US 2011/0192575 A1 Aug. 11, 2011

(30) Foreign Application Priority Data

Aug. 8, 2007 (FR) ..... 07 05770

(51) Int. Cl.
*F28D 15/00* (2006.01)

(52) U.S. Cl.
USPC ..... 165/104.26; 165/104.21; 165/104.33

(58) Field of Classification Search
USPC ..... 165/104.26
See application file for complete search history.

(56) References Cited

U.S. PATENT DOCUMENTS 3,543,839 A * 12/1970 Shlosinger ..... 165/274
3,683,214 A * 8/1972 Leffert ..... 310/10
4,883,116 A 11/1989 Seidenberg et al.
6,330,907 B1 * 12/2001 Ogushi et al. ..... 165/104.26
6,571,863 B1 * 6/2003 Liu ..... 165/104.21
2003/0051857 A1 * 3/2003 Cluzet et al. ..... 165/41
2003/0051859 A1 3/2003 Chesser et al.
2003/0178184 A1 * 9/2003 Kroliczek et al. ..... 165/104.26
2005/0081152 A1 4/2005 Commarford et al.
2006/0011328 A1 * 1/2006 Hul-Chun ..... 165/104.26
2008/0078530 A1 * 4/2008 Chang et al. ..... 165/104.26
2010/0155019 A1 * 6/2010 Zhou et al. ..... 165/60
2010/0307721 A1 * 12/2010 Wang ..... 165/104.26

OTHER PUBLICATIONS

F. Mestemacher and H. G. Wulz; Kapillargepumpte Zweiphasenkreisläufe für Raumfahrtanwendungen; Magazine; 1992; 294-300; No. 5, Bonn, DE.

French Preliminary Search Report from priority application No. FR 07 05770; Report dated Feb. 14, 2008.

International Search Report from PCT application No. PCT/FR2008/051313; report dated May 1, 2009.

* cited by examiner

*Primary Examiner* — Allen Flanigan
*Assistant Examiner* — Jason Thompson
(74) *Attorney, Agent, or Firm* — Miller, Matthias & Hull LLP

(57) ABSTRACT

Each loop of the device includes an evaporator and a condenser connected by an outer tube in a portion of which extends a thermally insulating sleeve having one end that can lead into the condenser and another end that surrounds a first portion (8*a*) of a microporous mass provided in the outer tube and pumping by capillarity a liquid-phase heat-carrier fluid flowing in the insulating sleeve of the condenser towards the evaporator, while the gaseous-phase fluid flows from a vapor-collecting central duct in a second portion of the mass of the evaporator towards the condenser in a duct inside said outer tube. The invention can be used for the thermal energy transfer from an electronic component or circuit defining a heat source in relation with the evaporator to a cold source in relation with the condenser.

20 Claims, 3 Drawing Sheets

PASSIVE DEVICE WITH MICRO CAPILLARY PUMPED FLUID LOOP

CROSS-REFERENCE TO RELATED APPLICATIONS

This application is a §371 National Phase Filing of International Patent Application No. PCT/FR2008/051313 claiming priority under the Paris Convention to French Application No. 07 05770, filed on Aug. 8, 2007.

FIELD OF THE DISCLOSURE

The present invention relates to a thermal regulation device with at least one micro capillary pumped fluid loop allowing for improved performance of the micro loop(s) that such a device comprises. These purely passive thermal regulation devices comprise at least one heat transfer loop with circulation of a heat-carrier fluid by capillary pumping used for cooling heat sources, such as electronic components or sets of components (circuits).

BACKGROUND OF THE DISCLOSURE

According to the state of the art, a heat transfer loop comprises an evaporator intended to extract heat from a heat source, and a condenser intended to return this heat to a cold source. The evaporator and the condenser are connected by tubing, in which a heat-carrier fluid flows in a liquid state in the cold part of the loop and in a gaseous state in the hot part of such loop. The device of the invention relates more particularly to fluid loops in which the pumping of the heat-carrier fluid is carried out by capillarity (capillary loop). In this type of loop, the evaporator is associated with a reserve of fluid in a liquid state, and comprises a microporous mass (also called a wick) carrying out the pumping of the fluid by capillarity. The liquid-phase fluid contained in the reserve associated with the evaporator evaporates in the microporous mass under the effect of the heat originating from the heat source. The gas created in this way is discharged to the condenser, in heat exchange contact with the cold source, where it condenses and returns in liquid phase to the evaporator, in order to thus create a heat transfer cycle.

The object of the present invention relates to passive thermal regulation devices having micro capillary pumped fluid loops, intended for the cooling of heat sources such as electronic components and/or circuits. According to the state of the art, such electronic components or circuits are characterised by a small size (thickness of 1 to 2 mm, area of 10 to 100 $mm^2$, for example) and high discharge power densities (over 50 $W/cm^2$, for example). Furthermore, the temperature variation between the junction of the electronic component or circuit and the housing of said component or circuit is very large (by a factor of 2 to 3) compared with the temperature variation of the housing of the component or circuit and the temperature of a base plate of a board on which the component or circuit is installed.

The use of a heat transfer loop with capillary pumping to fit the size of the component or circuit, known as a micro loop, allows for the temperature difference between the junction of the component or circuit and the base plate of the board on which it is installed to be reduced advantageously, and thus for the reliability of the component or circuit to be increased by increasing the power dissipated by the component or circuit.

Such a micro capillary pumped fluid loop is characterised in that it has small dimensions (typical thickness of 1 to 2 mm, typical surface area of 10 to 100 $mm^2$), in order to allow for it to be installed as close as possible to, or even inside, the component or circuit.

One of the limitations of heat transfer loops in operation lies in the more or less large quantity of thermal energy that is transferred to the liquid reserve through the evaporator.

A first effect of this parasitic phenomenon is the heating of the liquid flowing in the loop or contained in the evaporator reserve. A second parasitic effect is the reduction of the thermal performance of the transfer loop, which is very sensitive to the temperature of the liquid. Such a transfer loop transports almost all of the energy by phase change of the heat-carrier fluid and requires, in order to operate, several kilogram calories to keep the fluid flowing from the condenser to the evaporator in a liquid state. Even partial heating of this liquid by any means therefore very considerably reduces the heat transfer performance of the loop, and can even result in its complete stoppage.

SUMMARY OF THE DISCLOSURE

To overcome the drawbacks of the state of the art, the invention proposes a fluid loop device that is very simple to produce and limits these parasitic effects whilst improving the thermal performance of this type of loop. The device according to the invention is also advantageous for fluid loops with larger dimensions and heat transfer capacities.

To this end, the passive thermal regulation device according to the invention, including at least one heat transfer loop with capillary pumping of a heat-carrier fluid, said loop comprising an evaporator including a microporous mass, and a condenser, intended to be in heat exchange relationship with a heat source and a cold source respectively, and tubing connecting the evaporator to the condenser and transporting the heat-carrier fluid essentially in vapour phase from the evaporator to the condenser and essentially in liquid phase from the condenser to the evaporator, the tubing comprising an outer tube closed on itself and forming a continuous loop, and housing the substantially elongated and cylindrical microporous mass, which ensures the flow of liquid-phase heat-carrier fluid by capillary pumping, is characterised in that the liquid phase of the fluid originating from the condenser is pumped to a first longitudinal end of said microporous mass of the evaporator, and the vapour phase of the fluid is discharged by the second longitudinal end of said microporous mass of the evaporator, and said first longitudinal end is separated, by a first longitudinal portion of said microporous mass, from a second longitudinal portion of said microporous mass, in heat exchange relationship with the heat source, said first longitudinal portion extending into a thermally insulating sleeve located in a portion of said outer tube, the outer surface of said sleeve being in contact with the inner surface of said outer tube, while said second portion of the microporous mass is located outside said sleeve and in contact without play via its outer surface with the inner surface of said outer tube, in such a way as to ensure the seal between the liquid and vapour phases of the fluid.

In order to ensure good insulation, said first portion of the microporous mass extends into said insulating sleeve over a distance of one to several times the diameter of the outer tube, when the latter is cylindrical with a circular cross-section, and more generally over a distance of at least once the largest dimension of the cross-section of the outer tube, in all other cases.

Advantageously for its production, said microporous mass is constituted of a single piece.

Also advantageously, its porosity characteristics are homogeneous.

Advantageously, the sleeve is made from a synthetic material known as plastic, in such a way as to protect the first longitudinal portion of microporous mass of the evaporator from the parasitic heat flows originating from the heat source, and propagating in the second longitudinal portion of the microporous mass of the evaporator and in the portion of the outer tube at the evaporator, in order to avoid any heating of the liquid-phase fluid in contact with the first longitudinal end of the microporous mass of the evaporator.

Also advantageously, a longitudinal blind central duct is made in the second portion of microporous mass, collecting the vapour phase of said fluid heated in said second portion of the microporous mass, and opening out onto said second longitudinal end of the microporous mass, towards the outside of said mass and into the outer tube, in the direction of the condenser towards which the vapour phase is discharged.

Preferably, said central duct flares out from the inside of said microporous mass towards its second longitudinal end, in such a way that the flow of vapour collected in the central duct is greater the larger the cross-section of such central duct, due to a greater proximity of the heat source.

To facilitate the moistening of the microporous mass of the evaporator in its first longitudinal portion, it is also advantageous for the inner surface of the end portion of said sleeve, which is in contact with said first portion of microporous mass to comprise, over its entire length and at least part of its thickness, at least one capillary drain enabling said liquid phase of the fluid originating from the condenser to moisten said first portion of microporous mass in contact with said sleeve.

In a first embodiment, said at least one capillary drain of the end portion of the sleeve in contact with the first portion of microporous mass is constituted of at least one substantially longitudinal groove made on the inner surface of the sleeve, bringing the liquid into contact with the microporous mass.

Advantageously, to this end, grooves are made substantially longitudinally on the entire periphery of the inner surface of the sleeve, and their cross-sectional shape with a narrowed opening on said inner surface of the sleeve promotes the capillary pumping of the heat-carrier fluid.

In a second embodiment, said at least one capillary drain of the end portion of the sleeve in contact with the first portion of microporous mass is constituted of another microporous mass, the pores of which are larger, preferably with a radius two to ten times larger, than those of said microporous mass of the evaporator.

In this latter case, it can be advantageous for said other microporous mass to be annular and to completely surround said first longitudinal portion of microporous mass of the evaporator located in the sleeve.

The sleeve can extend as far as the condenser.

In this case, it is advantageous for said at least one capillary drain to extend from the condenser to the evaporator.

Furthermore, it is also advantageous for another microporous mass to be positioned at the corresponding end of the sleeve at the condenser, in such a way as to separate the vapour phase from the liquid phase and to pump the liquid phase towards the evaporator.

Generally, the microporous mass of the evaporator has a length that is 2 to 15 times greater than its diameter.

To enable the heat exchanges necessary for the operation of the loop, it is advantageous for the outer tube to be made from a good heat conducting material, at least on a part of the tube in heat exchange relationship with, on the one hand, the evaporator or constituting it, and, on the other hand, said microporous mass of the evaporator, and on another part of the tube in heat exchange relationship with said condenser or constituting it.

According to a simple and practical embodiment, said outer tube is metal, preferably stainless steel.

Furthermore, the outer tube is advantageously cylindrical having a circular cross-section with a constant diameter.

BRIEF DESCRIPTION OF THE DRAWINGS

Further characteristics and advantages will become apparent from the non-limitative description given below of specific examples of embodiments described with reference to the attached drawings, in which.

DETAILED DESCRIPTION OF THE DISCLOSURE

Figure 1:
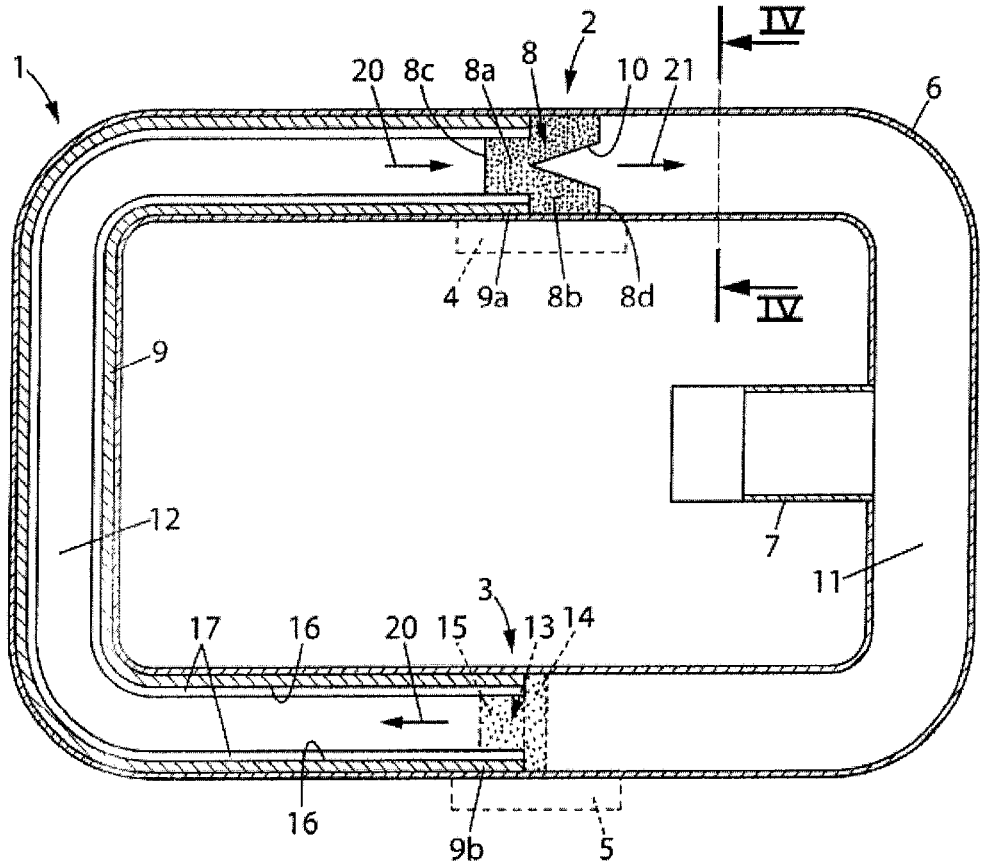
FIG. 1 is a longitudinal cross-sectional diagrammatic representation of a micro loop in its entirety.
Figure 4:
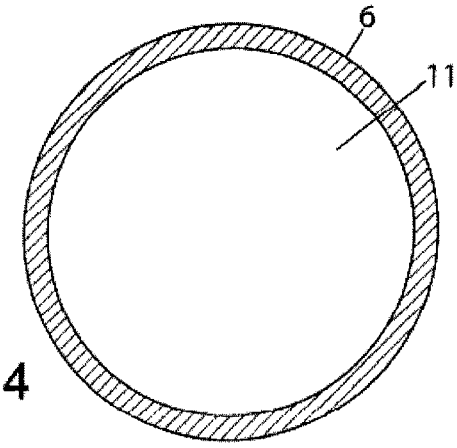
FIG. 4 is a cross-section at the outer tube, between the evaporator and the condenser, along the line IV-IV in FIG. 1.
Figure 2:
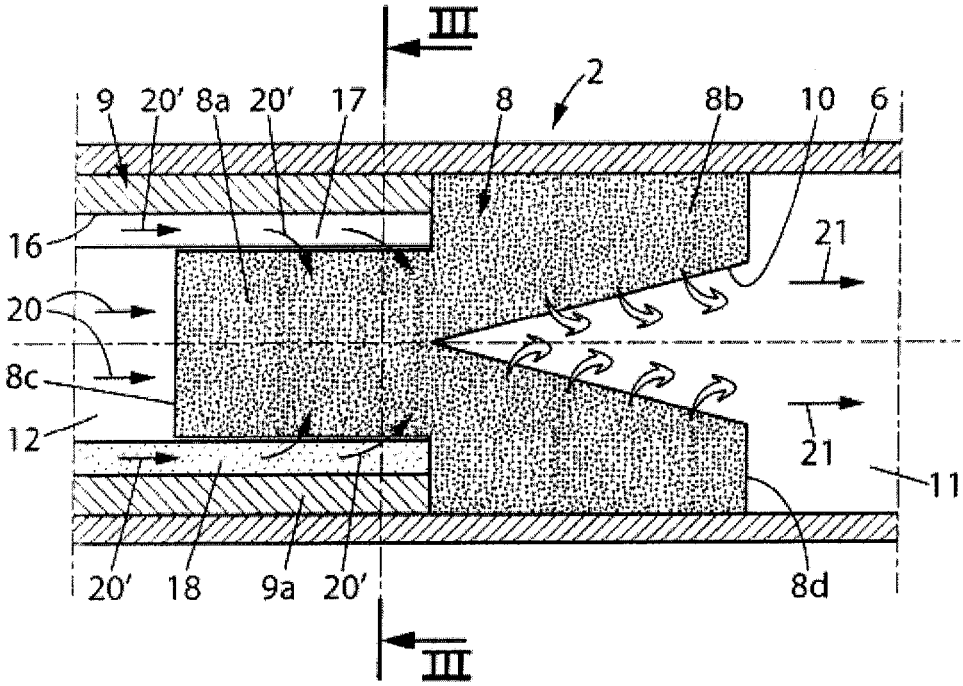
FIG. 2 is a diagrammatic longitudinal cross-sectional view of the evaporator with microporous mass (or wick) in FIG. 1.
Figure 3:
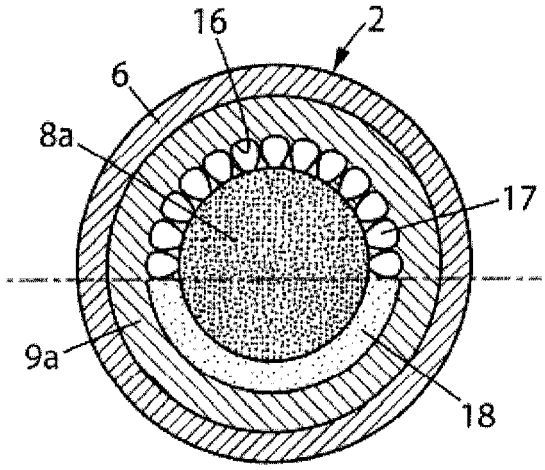
FIG. 3 is a cross-section at the wick, along the line III-III in FIG. 2.
Figure 5:
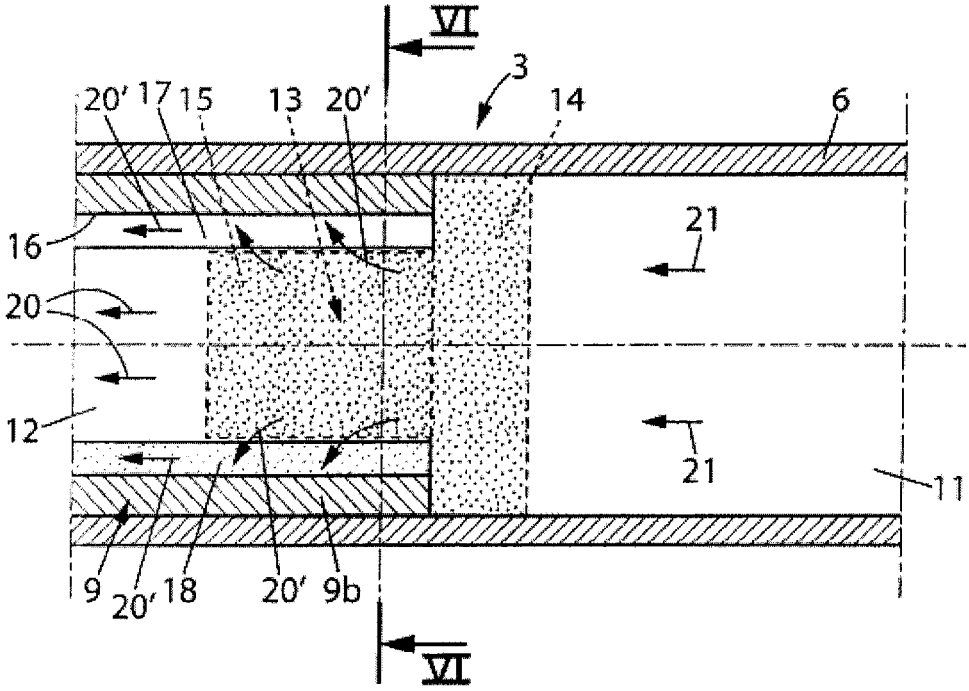
FIG. 5 is a similar view to FIG. 2, for the condenser of the micro loop in FIG. 1.
Figure 6:
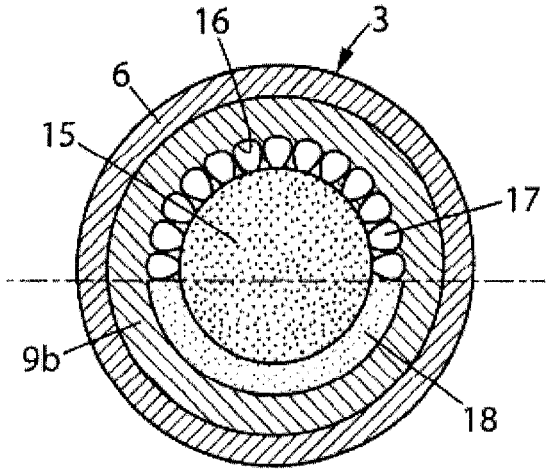
FIG. 6 is a cross-sectional view at the condenser of the micro loop in FIG. 1, along the line VI-VI in FIG. 5.

An example of an embodiment of the passive thermal regulation device of the invention is illustrated in FIG. 1, showing a longitudinal cross-section of the entirety of a micro loop 1, FIGS. 2 and 5 showing a longitudinal cross-section of the areas of the loop encompassing the evaporator 2 and the condenser 3 respectively and FIGS. 3 and 6 respectively showing a cross-section of the evaporator 2 and of the condenser 3, while FIG. 4 shows a cross-section of the loop 1 at the vapour-phase fluid duct between the evaporator 2 and the condenser 3. All of the numerical values and technical characteristics relating to the materials and fluids given below are for information only. This information is compatible with the industrial production of the invention using the existing equipment of the state of the art.

In this embodiment, the device with micro capillary pumped fluid loop 1 comprises an outer tube 6 with walls made from a good heat conducting material, advantageously metal, for example stainless steel, that is for example a cylindrical tube with a circular cross-section, with a constant outer diameter of 2 mm, and a constant wall thickness of 0.2 mm. This tube 6 is closed on itself in a continuous loop to form a closed circuit, in which flows a heat-carrier fluid, which can typically be ammonia, water, or any other diphasic fluid. A filling tube 7 of the micro loop 1 connected to the main tube 6 is shown in FIG. 1. The tube 7 is of the same type as the tube 6, and connects perpendicularly to a straight portion of the tube 6, between the evaporator 2 and the condenser 3, in an area in which no components are present in the tube 6.

At the evaporator 2, a microporous mass or wick 8, having a generally cylindrical shape with a circular cross-section, is positioned inside a straight section of the tube 6.

A cylindrical thermally insulating sleeve 9 with a circular cross-section, made from a synthetic material known as plastic, extends into substantially half of the outer tube 6, which extends between the evaporator 2 and the condenser 3, and into which the filling tube 7 does not open. The inner and outer diameters of the sleeve 9 are constant, and the outer surface of the sleeve 9 is in contact with the inner surface of the outer tube 6.

The wick 8 comprises a first longitudinal portion 8*a* of microporous mass, which has a cylindrical shape with a circular cross-section and is engaged without radial play in the end portion 9*a* of the sleeve 9 adjacent to the evaporator 2, as well as a second longitudinal portion 8*b* of microporous mass, also having a cylindrical shape with a circular cross-section, extending axially from the first portion 8*a*, but outside the sleeve 9, and in contact without radial play via its outer lateral surface against the inner surface of the outer tube 6, which provides a seal between the vapour and liquid phases. The wick 8 extends axially from a first longitudinal end face 8*c*, ending the first portion 8*a* of wick 8 inside the sleeve 9, to a second longitudinal end face 8*d*, ending the second portion 8*b* of wick 8 inside the outer tube 6, over a length that corresponds to approximately 2 to 15 times the diameter of its longitudinal portion with the largest diameter, i.e., the second portion 8*b*, that is, a length of approximately 4 mm to approximately 24 mm for example. The first portion 8*a* of microporous mass extends into the sleeve 9 over a distance of approximately one to several times the diameter of the outer tube 6, i.e. at least of the order of 2 mm, but preferably more, and can be up to the order of 10 mm when the total length of the wick 8 is of the order of 24 mm. The outer diameter of the second portion 8*b* of the microporous mass is therefore 1.6 mm. The microporous mass 8 can be made from a single monolithic block with the same composition, i.e., the porosity characteristics of which are homogeneous in the portions 8*a* and 8*b*, for example with pores the diameter or main dimension of which is of the order of 1 to 10 μm.

In a variant embodiment, the pores can optionally have variable dimensions, for example ranging from large pores in the first portion 8*a* of the wick 8, to promote the capillary pumping of the liquid and its insulation vis-à-vis parasitic heat flows originating from a heat source 4 and the second portion 8*b* of wick in heat exchange relationship with said heat source 4, to small pores in said second portion 8*b* of the wick 8, where the vaporization of the pumped liquid fluid takes place, as explained below.

Also as a variant, the two portions 8*a* and 8*b* of the microporous mass can be separate and placed axially next to each other in such a way as to enable the first portion 8*a* to supply the second portion 8*b* with liquid fluid by capillarity.

As a further variant, the evaporator 2 can also comprise a cylindrical outer sleeve (not shown), also with a circular cross-section, that is passed through axially and without substantial radial play by the portion of the outer tube 6, which surrounds the microporous mass 8, this outer sleeve being made from a good heat conducting material, preferably metal, and, optionally, of the same type as the outer tube 6, i.e., stainless steel, the length of this outer sleeve, along its axis, which is also the axis of this section of the tube 6 and of the microporous mass 8 (as these three components are substantially co-axial in this variant) capable of being approximately half of the length of the mass 8.

Thus, this outer sleeve, when it is present, is in good heat exchange relationship with the outer tube 6, which is still in good heat exchange relationship with the second portion 8*b* of the microporous mass 8, over the entire outer lateral surface of such second portion 8*b*, in which a blind, longitudinal central duct 10 is made, with a conical shape and circular cross-section, which flares from the axial end of the second portion 8*b*, which is adjacent to the first portion 8*a*, to the second end surface 8*d* on which the duct 10 opens out towards the outside of the wick 8, in the outer tube 6 in the direction of the condenser 3.

This central duct 10 collects the vapour phase of the fluid heated and vaporized in the second portion 8*b* of microporous mass, which is supplied with liquid fluid by capillary pumping by the first portion 8*a* of microporous mass, in contact via the first end face 8*c* with the liquid-phase fluid present in the insulating sleeve 9 and flowing, as a result of this capillary pumping, from the condenser 3 towards the evaporator 2.

To this end, the evaporator 2 can be put in heat exchange relationship with a heat source 4, shown in dotted lines in FIG. 1 by a rectangular body, which can be an electronic circuit or component to be cooled, and against which the portion of the outer tube 6 of the evaporator 2, surrounding the microporous mass 8, and mainly its second portion 8*b*, is in contact promoting heat transfers by conduction from the heat source 4 to this portion of outer tube 6, itself in good heat exchange relationship, as already mentioned above, with the microporous mass 8, as a result of the co-axial mounting without radial play of this mass 8 via its second portion 8*b*, in this section of tube 6 of the evaporator 2.

The longitudinal central duct 10 inside the second portion 8*b* of microporous mass, through which the vapour phase is collected and discharged to the condenser 3, can be cylindrical, but its flared (conical) shape is advantageous, as in this case, the vapour flow rate is greater the larger the diameter of the cross-section of the duct 10, due to the greater proximity of the heat source 4, and the flow of vapour out of the wick 8 and towards the condenser 3 is improved as a result.

However, due to the presence of the insulating sleeve 9, the end portion 9*a* of which surrounds the first portion 8*a* of microporous mass, and due to the length of this first portion 8*a*, the first end surface 8*c* of the microporous mass 8 is kept sufficiently far away from the second portion 8*b* in heat exchange relationship with the heat source 4, for the end surface 8*c* to be protected from the parasitic heat flows originating from the heat source 4 via the outer tube 6 and from the second portion 8*b* of the microporous mass. The liquid phase, which arrives at the end 8*c* of the wick 8, is thus kept away from the hot portion 8*b* where the vapour is formed, by the first portion 8*a* of wick, and from the heat source 4 and the tube 6 by the insulating sleeve 9.

To improve the heat exchanges at the contact surfaces, the second portion 8*b* of microporous mass is attached to the inner cylindrical wall of the tube 6 of the evaporator 2 by any means that ensures the best thermal contact possible, for example by bonding, sintering or any other means.

The micro loop 1 also comprises the condenser 3 located, in this example, on a straight section of the outer tube 6 that is opposite the straight section of tube 6 of the evaporator 2, in the loop formed by this outer tube 6 and in relation to the centre of the loop.

As for the evaporator 2, the condenser 3 can comprise as a variant a cylindrical outer sleeve (not shown) made from a good heat conducting material, preferably metal, that is in good heat exchange contact with the section of outer tube 6 that passes through it, on the one hand, and on the other hand with a cold source 5, shown diagrammatically in FIG. 1 by a dotted rectangle, and which can be a heat sink, for example a metal component of a load-bearing structure.

As for the evaporator 2, the outer sleeve of the condenser 3 can optionally comprise a base plate (not shown) promoting heat exchange contact with the cold source 5, and, as in the evaporator 2, in the absence of a conducting outer sleeve of the condenser 3, the thermal contact between the condenser 3 and the cold source 5 is provided by the portion of outer tube 6 of the condenser 3, in such a way as to cause, in this portion of tube 6, the condensation of the vapour phase discharged from the central duct 10 of the wick 8 of the evaporator 2 and flowing in the vapour duct 11 delimited in substantially the half of the outer tube 6 extending between the evaporator 2 and the condenser 3 on the side of the filling tube 7. The liquid condensed in the condenser 3 flows in the liquid duct 12 delimited in the insulating sleeve 9 extending in substantially the other half of the outer tube 6, as already explained above.

In order to promote the separation of the vapour phase and the liquid phase generated by condensation at the condenser 3, it can be advantageous to have in the condenser 3 another optional microporous mass 13, the function of which is to capture the liquid phase by capillarity at the condenser 3, while preventing the vapour phase from passing into the liquid duct 12. This other microporous mass 13 (shown in dotted lines in FIG. 5), which has greater porosity than the wick 8, is positioned at the corresponding end 9*b* of the insulating sleeve 9. This mass 13 comprises a first portion in the form of a circular disc 14 extending over the entire cross-section of the outer tube 6, and pressed axially against the corresponding end 9*b* of the insulating sleeve 9, and radially in contact with the inner surface of the tube 6, and a second portion in the form of a truncated cylinder 15, fitted without radial play into the end part 9*b* of the sleeve 9, in order to pump the condensed liquid by capillarity and convey it into the liquid duct 12.

The device operates as follows. The evaporator 2 collects heat generated by the heat source 4, which is conveyed, by conduction, into the section of the outer tube 6 in contact with the second portion 8*b* of the microporous mass 8.

This portion 8*b* of microporous mass, heated in this way by the section of outer tube 6 surrounding it, heats the liquid-phase fluid originating from the duct 12 and that has been sucked up and pumped by capillarity by the first portion 6*a* of microporous mass, sufficiently long axially to thermally insulate the liquid in the duct 12, which can thus contain a reserve of liquid close to the wick 8. The axial end surface 8*c* of the wick 8 where the liquid phase arrives is also separated from the second portion 8*b* of this wick 8 which is in heat exchange with the heat source 4. In other words, the first longitudinal portion 8*a* of the microporous mass 8 keeps the liquid away from the hot second portion 8*b* where vaporization takes place. The liquid-phase fluid pumped into the microporous mass 8 is vaporized in the second longitudinal portion 8*b* and the vapour is collected in the central duct 10 of the mass 8, whence the vapour-phase fluid is discharged towards the vapour duct 11, which guides the vapour-phase fluid to the condenser 3, where the vapour of this fluid condenses, and the liquid condensates are pumped by the microporous mass 13 and guided by the liquid duct 12 from the condenser 3 to the evaporator 2, to ensure the liquid-phase fluid supply of the microporous mass 8, via its end face 8*c* and its first longitudinal portion 8*a*, as already mentioned above.

The latent heat of condensation is transferred by the condenser 3 to the cold source 5 through the outer tube 6.

Thus, the liquid-phase fluid moves according to the arrows 20 in FIGS. 1, 2 and 5 in the liquid duct 12, from the condenser 3 to the microporous mass 8 of the evaporator 2, whilst the vapour generated by the evaporator 2 during the operation of the loop is recovered in the central duct 10 of the mass 8, in the second longitudinal portion 8*b* of the latter, and discharged into the vapour duct 11, in which the vapour-phase fluid moves according to the arrows 21 in FIGS. 1, 2 and 5, from the evaporator 2 to the condenser 3, where this duct 11 communicates with the liquid-phase fluid return duct 12 to the evaporator 2 by means of the microporous mass 13, which can be a monolithic mass, or constituted of two separate parts 14 and 15 placed longitudinally next to each other.

Due to the considerable length of the microporous mass 8 relative to its diameter and relative to the dimensions of the heat collecting zone in the evaporator 2, the liquid-phase fluid reserve contained in the duct 12, inside the insulating sleeve 9, is sufficiently far away from the heat source 4, despite the small size of the evaporator 2, to minimise the parasitic flow of thermal energy towards this liquid reserve, which allows for the improvement of the thermal performance of the device.

It must be noted that the outer tube 6, as a variant, can be made from a good heat conducting material only on the two sections of the outer tube 6 that, for one, surrounds the microporous mass 8 and, for the other, constitutes in itself the jacket of the condenser 3.

In order to improve the supply of the wick 8 with liquid-phase fluid, by improving the moistening of the first portion 8*a* of microporous mass of the evaporator 2, capillary drains 17 are arranged in the inner surface of the insulating sleeve 9, at least over the length of the end portion 9*a* of the sleeve 9 (see FIG. 2), and preferably, as shown in FIG. 1, these drains 17 extend from the condenser 3 to the evaporator 2, along the entire length of the sleeve 9.

In a first embodiment as shown in FIG. 1 and the upper half cross-sections in FIGS. 2, 3, 5 and 6, the capillary drains 17 are formed by grooves 16 made on the inner surface of the insulating sleeve 9, at least on the end portion 9*a* of the sleeve 9, into which the first portion 8*a* of microporous mass is fitted, in such a way as to convey liquid to a high level around said portion 8*a*. A large number of grooves 16 can be made on the entire inner radial periphery of the insulating sleeve 9, in order to optimise the pumping flow rate of the fluid from the condenser 3 to the evaporator 2 (see the upper half cross-sections in FIGS. 2, 3, 5 and 6). These capillary drains 17 in the form of grooves 16 with small cross-sections, in this example in the form of droplets, which narrow at their opening on the inner surface of the sleeve 9 (see upper half cross-sections in FIGS. 3 and 6), and therefore have a cross-section that promotes the capillary pumping of the liquid used in the loop, extend advantageously over the entire length of the sleeve 9 up to the condenser 3, in the end 9*b* of the sleeve 9. However, these grooves 16, which can be longitudinal (parallel to the axis of the sleeve 9) or helical, do not penetrate further than the inner radial half of the thickness of the wall of the sleeve 9, in order to maintain good thermal insulation between the vapour and liquid phases of the fluid.

In another variant, the capillary drains 17 can be constituted of the grooves 16 filled with a microporous material, the porosity of which is substantially the same as or, preferably, greater than that of the microporous mass 13 of the condenser, which itself has greater porosity than the wick 8 of the evaporator 2.

In another variant, shown in the lower half cross-sections in FIGS. 2, 3, 5 and 6, the capillary drains 17 in the form of grooves 16 can be replaced, at least on the end portion 9*a* of the sleeve 9, by yet another microporous mass 18, preferably annular, surrounded by the insulating sleeve 9, which is thinner at this point, and itself surrounding the first portion 8*a* of the microporous mass 8, this other microporous mass 18 being capable of having a different composition from the microporous mass 8 of the evaporator 2, and in particular from its second portion 8*b*, for example having pores with a significantly larger average diameter, typically by a factor of 2 to 10, than the average diameter of the pores of the microporous mass 8.

In this example in FIGS. 2, 3, 5, and 6, the end portion 9*b* of the sleeve 9 also surrounds the microporous mass 18 forming a capillary drain, which itself surrounds the portion 15 of the microporous mass 13, in such a way that the capillary drain guides the condensed liquid from deep inside the mass 13 by capillarity.

In these variants of liquid supply capillary drain(s) 17 and 18, the flow of the liquid takes place according to the arrows 20' in FIGS. 2 and 5.

Given the small dimensions of a device with at least one fluid micro loop according to the invention, such a device can be advantageously applied to the transfer of thermal energy from a heat source 4 with a high thermal power density but small dimensions, such as an electronic component or circuit, placed in heat exchange relationship with the evaporator 2 of the device of the invention, to a cold source 5 placed in heat exchange relationship with the condenser 3 of said device.

The invention claimed is:

1. A passive thermal regulation device, comprising at least one heat transfer loop with capillary pumping of a heat-carrier fluid, said loop comprising an evaporator including a microporous mass, and a condenser for being in heat exchange relationship with a heat source and a cold source respectively, and tubing connecting said evaporator to said condenser and transporting said heat-carrier fluid essentially in vapour phase from said evaporator to said condenser and essentially in liquid phase from said condenser to said evaporator, said tubing comprising an outer tube closed on itself and forming a continuous loop, and housing said 1 microporous mass, which has a substantially elongated and cylindrical shape and which ensures a flow of said liquid-phase heat-carrier fluid by capillary pumping, wherein said liquid phase of said fluid originating from said condenser is pumped to a first longitudinal end of said microporous mass of said evaporator, and said vapour phase of said fluid is discharged by a second longitudinal end of said microporous mass of said evaporator, and said first longitudinal end is separated by a first longitudinal portion of said microporous mass from a second longitudinal portion of said microporous mass in heat exchange relationship with the heat source, said first longitudinal portion extending into a thermally insulating sleeve located in a portion of said outer tube, said sleeve having an outer surface which is in contact with an inner surface of said outer tube, while said second portion of microporous mass is located outside said sleeve and has an outer surface which is in contact without play with said inner surface of said outer tube, wherein an inner surface of at least an end portion of said sleeve, which is in contact with said first portion of microporous mass, comprises, over an entire length and over at least part of a thickness of said inner surface, at least one capillary drain allowing for said liquid phase of said fluid originating from said condenser to moisten said first portion of microporous mass in contact with said sleeve.

2. The device according to claim 1, wherein said sleeve is made from a synthetic material known as plastic.

3. The device according to claim 1, wherein said outer tube has a diameter and said first portion of said microporous mass extends into said sleeve over a distance of one to several times said diameter of said outer tube.

4. The device according to claim 1 wherein said microporous mass is constituted of a single piece.

5. The device according to claim 1 wherein said microporous mass has porosity characteristics which are homogeneous.

6. The device according to claim 1 wherein a longitudinal blind central duct is made in said second portion of microporous mass for collecting said vapour phase of said fluid heated in said second portion of microporous mass and opening onto said second longitudinal end of said microporous mass towards an outside of said mass and into said outer tube in the direction of said condenser towards which said vapour phase is discharged.

7. The device according to claim 6, wherein said central duct flares out from inside said microporous mass towards said second longitudinal end of said microporous mass.

8. The device according to claim 1, wherein said at least one capillary drain of said end portion of said sleeve in contact with said first portion of microporous mass is constituted of at least one substantially longitudinal groove made on said inner surface of said sleeve and bringing said liquid in contact with said microporous mass.

9. The device according to claim 8, wherein grooves are made substantially longitudinally on an entire periphery of said inner surface of said sleeve, and said groves have a cross-sectional shape with a narrowed opening on said inner surface of said sleeve promoting a capillary pumping of said heat-carrier fluid.

10. The device according to claim 1, wherein said at least one capillary drain of said end portion of said sleeve in contact with said first portion of microporous mass is constituted of a second microporous mass having pores which are larger than pores of said microporous mass of said evaporator.

11. The device according to claim 10, wherein said second microporous mass is annular and completely surrounds said first longitudinal portion of microporous mass of said evaporator located in said sleeve.

12. The device according to claim 1 wherein said sleeve extends as far as said condenser.

13. The device according to claim 12, wherein said at least one capillary drain extends from said condenser to said evaporator.

14. The device according to claim 12, wherein at said condenser a third microporous mass is positioned at a corresponding end of said sleeve in such a way as to separate said vapour phase from said liquid phase and pump said liquid phase towards said evaporator.

15. The device according to claim 1, wherein said microporous mass of said evaporator has a length that is 2 to 15 times greater than said diameter of said microporous mass.

16. The device according to claim 1, wherein said outer tube is made from a good heat conducting material at least on a first part of said outer tube which is in heat exchange relationship with, on the one hand, said evaporator or constituting said evaporator and, on the other hand, said microporous mass of said evaporator and on a second part of said tube in heat exchange relationship with said condenser or constituting said condenser.

17. The device according to claim 1, wherein said outer tube is metal.

18. The device according to claim 1 wherein said outer tube is cylindrical with a circular cross-section with a constant diameter.

19. The device according to claim 1, wherein said sleeve extends as far as said condenser.

20. A method for transferring thermal energy from a heat source to a cold source with a passive thermal regulation device with at least one heat transfer loop, including a step of using a heat transfer loop with capillary pumping of a heat-carrier fluid, said loop comprising an evaporator including a microporous mass and a condenser, and coupling said evaporator and said condenser in heat exchange relationship with a heat source and a cold source respectively, and tubing connecting said evaporator to said condenser and transporting said heat-carrier fluid essentially in vapour phase from said evaporator to said condenser and essentially in liquid phase from said condenser to said evaporator, said tubing comprising an outer tube closed on itself and forming a continuous loop, and housing said microporous mass, which has a substantially elongated and cylindrical shape and which ensures a flow of said liquid-phase heat-carrier fluid by capillary pumping, wherein said liquid phase of said fluid originating from said condenser is pumped to a first longitudinal end of said microporous mass of said evaporator, and said vapour phase of said fluid is discharged by a second longitudinal end of said microporous mass of said evaporator, and said first longitudinal end is separated by a first longitudinal portion of said microporous mass from a second longitudinal portion of said microporous mass in heat exchange relationship with the heat source, said first longitudinal portion extending into a thermally insulating sleeve located in a portion of said outer tube, said sleeve having an outer surface which is in contact with an inner surface of said outer tube, and, an inner surface of at least an end portion of the sleeve, which is in contact with said first portion of the microporous mass, comprises, over an entire length and over at least part of a thickness of said inner surface, at least one capillary drain allowing for said liquid phase of said fluid originating from said condenser to moisten said first portion of the microporous mass in contact with said sleeve while said second portion of microporous mass is located outside said sleeve and has an outer surface which is in contact without play with said inner surface of said outer tube.

* * * * *